US006904890B2

(12) United States Patent
Maitani et al.

(10) Patent No.: US 6,904,890 B2
(45) Date of Patent: Jun. 14, 2005

(54) START-UP CONTROL OF IN-CYLINDER FUEL INJECTION SPARK IGNITION INTERNAL COMBUSTION ENGINE

(75) Inventors: Takao Maitani, Isehara (JP); Masayuki Tomita, Yokohama (JP); Tsutomu Kikuchi, Tokyo (JP); Masahiko Yuya, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/885,014

(22) Filed: Jul. 7, 2004

(65) Prior Publication Data

US 2005/0005903 A1 Jan. 13, 2005

(30) Foreign Application Priority Data

Jul. 8, 2003 (JP) ..... 2003-193447

(51) Int. Cl.[7] ..... F02B 3/00
(52) U.S. Cl. ..... 123/294; 123/299
(58) Field of Search ..... 123/294, 299, 123/300, 305, 311, 395

(56) References Cited

FOREIGN PATENT DOCUMENTS

JP 2002-89401 A 3/2002

OTHER PUBLICATIONS

U.S. Appl. No. 10/885,076, filed Jul. 7, 2004, Iriya et al.

*Primary Examiner*—Bibhu Mohanty
(74) *Attorney, Agent, or Firm*—Foley & Lardner LLP

(57) ABSTRACT

During start-up of an in-cylinder fuel injection spark ignition engine (1), an engine controller (21) calculates a start-up fuel injection pulse width TIST on the basis of a cooling water temperature Tw, an engine rotation speed Ne, and a fuel supply pressure Pf to a fuel injector (8) (S1). When the fuel supply pressure Pf exceeds a required fuel pressure, the engine controller (21) executes stratified combustion by means of compression stroke fuel injection. By setting the required fuel pressure precisely in accordance with a start-up condition defined by the start-up fuel injection pulse width TIST and the engine rotation speed Ne, the opportunities for stratified combustion during start-up increase, and the amount of hydrocarbon discharge decreases.

10 Claims, 6 Drawing Sheets

START-UP CONTROL OF IN-CYLINDER FUEL INJECTION SPARK IGNITION INTERNAL COMBUSTION ENGINE

FIELD OF THE INVENTION

This invention relates to fuel injection control during start-up of a spark ignition internal combustion engine which injects fuel directly into a combustion chamber of a cylinder.

BACKGROUND OF THE INVENTION

JP2002-089401A, published by the Japan Patent Office in 2002, discloses a common rail fuel supply device in which fuel that has been pressurized by an electric low pressure pump is increased in pressure by a high pressure fuel pump driven by an internal combustion engine, and accumulated in an accumulator, whereupon the fuel is distributed from the accumulator to a fuel injector in each of a plurality of cylinders.

SUMMARY OF THE INVENTION

To suppress the discharge of unburned fuel, or in other words hydrocarbon (HC), during a cold start in an in-cylinder fuel injection spark ignition engine, compression stroke fuel injection is preferably performed early such that stratified combustion can be performed at an air-fuel ratio in the vicinity of the stoichiometric air-fuel ratio. When stratified combustion is performed, uneven air-fuel mixture is burned, producing so-called after-burning. After-burning accelerates the combustion of unburned fuel, or HC, and as a result, the amount of HC discharge decreases.

In the compression stroke, the pressure in the combustion chamber increases greatly. To perform compression stroke fuel injection, the fuel injector has to inject fuel against the increased combustion chamber pressure.

When applied to compression stroke fuel injection in an in-cylinder fuel injection spark ignition engine, the prior art prohibits injection until the fuel pressure in the accumulator rises to a predetermined pressure at which compression stroke fuel injection is possible. The high pressure fuel pump according to the prior art is a variable displacement single cylinder plunger pump in which a plunger driving cam is rotated at half the engine rotation speed. The discharge amount from the high pressure fuel pump is determined by the stroke amount of the plunger per revolution of the plunger driving cam and the cranking rotation speed. Hence the speed at which the fuel pressure in the accumulator rises during engine start-up is dependent on the discharge amount from the high pressure fuel pump during engine start-up. At a low cranking rotation speed, the discharge amount from the high pressure fuel pump is small, and hence a large period of time is required for compression stroke fuel injection to become possible. Intake stroke injection must be performed until compression stroke fuel injection becomes possible, and during this time increases in the amount of HC discharge are inevitable.

It is therefore an object of this invention to expedite the start timing of compression stroke fuel injection during start-up of an in-cylinder fuel injection spark ignition engine while using the high pressure fuel pump according to the prior art.

In order to achieve the above object, this invention provides a start-up fuel injection control device for an in-cylinder fuel injection internal combustion engine which operates on a four-stroke cycle constituted by an intake stroke, a compression stroke, an expansion stroke, and an exhaust stroke and comprises a fuel injector which injects fuel directly into a combustion chamber. The control device controls a fuel injection timing in accordance with a rotation speed of the engine, and a fuel pressure at which fuel is supplied to the fuel injector.

The control device comprises a programmable controller programmed to set a target fuel injection amount during start-up which corresponds to an air-fuel ratio in the vicinity of a stoichiometric air-fuel ratio, determine whether or not a compression stroke fuel injection condition has been established on the basis of the target fuel injection amount during start-up, the engine rotation speed, and the fuel pressure, and control the fuel injector to inject fuel during the compression stroke only when the compression stroke fuel injection condition has been established.

This invention also provides a start-up fuel injection control method for the in-cylinder fuel injection internal combustion engine described above.

The control method controls a fuel injection timing in accordance with a rotation speed of the engine, and a fuel pressure at which fuel is supplied to the fuel injector by setting a target fuel injection amount during start-up which corresponds to an air-fuel ratio in the vicinity of a stoichiometric air-fuel ratio, determining whether or not a compression stroke fuel injection condition has been established on the basis of the target fuel injection amount during start-up, the engine rotation speed, and the fuel pressure, and controlling the fuel injector to inject fuel during the compression stroke only when the compression stroke fuel injection condition has been established.

The details as well as other features and advantages of this invention are set forth in the remainder of the specification and are shown in the accompanying drawings.

DESCRIPTION OF THE PREFERRED EMBODIMENTS

Figure 1:
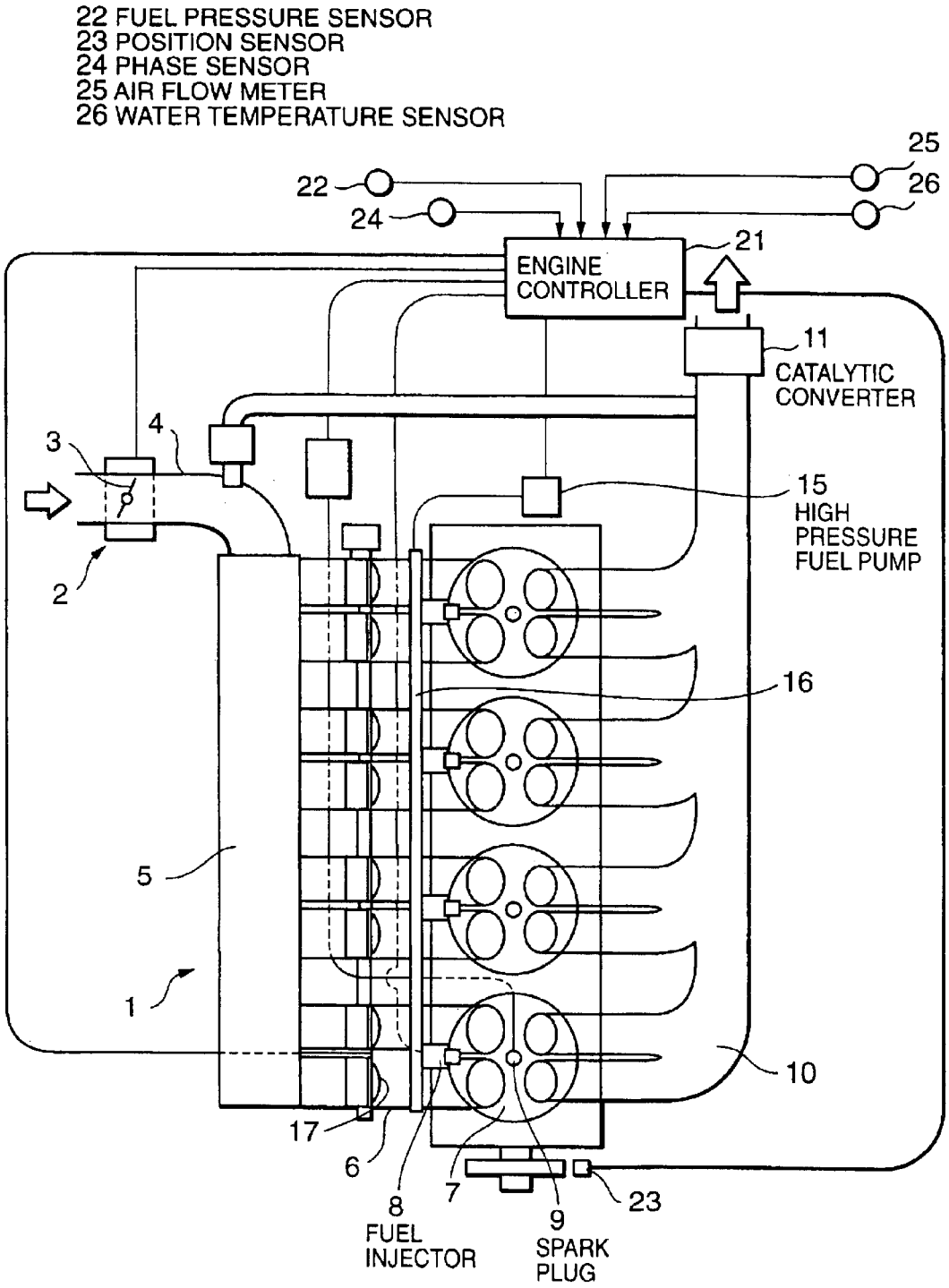
FIG. 1 is a schematic diagram of a start-up fuel injection control device for an in-cylinder fuel injection spark ignition engine according to this invention.

Referring to FIG. 1 of the drawings, an in -cylinder fuel injection spark ignition internal combustion engine 1 for use in a vehicle is constituted by a four-stroke cycle, water-cooled, four-cylinder gasoline engine in which an intake stroke, a compression stroke, an expansion stroke, and an exhaust stroke are repeated in succession.

The internal combustion engine 1 comprises four combustion chambers 7. Air is aspirated into each combustion chamber 7 from an intake manifold 6. The intake manifold 6 is connected to an intake passage 4 via a collector 5. The intake passage 4 comprises an electronic throttle 3 which regulates the amount of intake air. The internal combustion engine 1 comprises a fuel injector 8 and a spark plug 9 which face the combustion chamber 7. High-pressure fuel is supplied to the fuel injector 8 from a high pressure fuel pump 15 through a common rail 16. The common rail 16 functions as an accumulator for storing the high-pressure fuel discharged by the high pressure fuel pump 15 temporarily while maintaining the pressure thereof. Fuel that is subject to pressurization by the high pressure fuel pump 15 is supplied from a fuel tank through a low pressure pump. The high pressure fuel pump 15 is constituted by a single cylinder plunger pump which is driven by the internal combustion engine 1.

Fuel injected into the combustion chamber 7 by the fuel injector 8 mixes with air aspirated from the intake manifold 6 to form an air-fuel mixture which is burned when the spark plug 9 ignites. Combustion gas is discharged into the atmosphere from an exhaust manifold 10 via a catalytic converter 11. The catalytic converter is constituted by a three-way catalyst and a nitrogen oxide (NOx) trapping catalyst.

It should be noted that an intake valve is provided between the combustion chamber 7 and the intake manifold 6, and an exhaust valve is provided between the combustion chamber 7 and the exhaust manifold 10, but since the functions and operations of these valves bear no relation to this invention, they have been omitted from FIG. 1.

A tumble control valve 17 is provided on the intake manifold 6. When the tumble control valve 17 is closed, tumble, or vertical swirl, is generated by the intake air in the combustion chamber 7. As a result of the interaction between the tumble and a cavity formed at the crown of the piston, the fuel injected by the fuel injector 8 in the compression stroke mixes with the intake air, thus producing an air-fuel mixture with a high fuel concentration about the spark plug 9 and an air-fuel mixture with a low fuel concentration on the outside thereof. The generation of a stratified air-fuel mixture using this method is known as an air guide system. When the spark plug 9 ignites the stratified air-fuel mixture, so-called stratified combustion is performed.

On the other hand, when intake stroke fuel injection is performed with the tumble control valve 17 open, the injected fuel diffuses through the combustion chamber 7 uniformly. When the spark plug 9 ignites the air-fuel mixture in this condition, so-called homogeneous combustion is performed.

The fuel injector 8 injects fuel for a period corresponding to the length of the pulse of an injection pulse signal at a timing which corresponds to the output of this signal from an engine controller 21. The fuel injection amount of the fuel injector 8 is commensurate with the injection period of the fuel injector 8 and the fuel pressure in the common rail 16. The discharge amount from the high pressure fuel pump 15 is controlled by a signal that is output from the engine controller 21.

The fuel pressure that is required in the common rail 16 varies according to the engine load and engine rotation speed of the internal combustion engine 1. When the engine load is constant, a higher fuel pressure is required as the engine rotation speed increases. When the engine rotation speed is constant, a higher fuel pressure is required as the engine load increases. The required fuel pressure varies within a wide range having a minimum value of approximately 0.5 megapascals (MPa) and a maximum value of approximately 11 MPa.

If the required fuel pressure is assumed to be a constant value, then variation in the required fuel injection amount must be accommodated by the injection period of the fuel injector 8 alone. In this case, requirements regarding the specifications of the fuel injector 8 become strict. However, the required fuel injection amount can be satisfied by varying the fuel pressure in accordance with the engine load and engine rotation speed without greatly varying the injection period of the fuel injector 8.

The high pressure fuel pump 15 comprises in its interior a return passage which recirculates discharged fuel into the fuel tank, and an electromagnetic control valve which regulates the flow rate of the return passage in accordance with a duty signal.

Next, a start-up fuel injection control device of the in-cylinder fuel injection spark ignition internal combustion engine 1 will be described. Start-up of the internal combustion engine 1 is performed similarly to a normal vehicle engine by cranking using a starter motor.

The start-up fuel injection control device comprises the engine controller 21 which controls the fuel injection timing and injection amount of the fuel injector 8, the fuel pressure of the common rail 16 and the opening/closing of the tumble control valve 17 during start-up of the internal combustion engine 1. As shown in the drawings, the engine controller 21 not only controls fuel injection during start-up, but also controls general operations of the internal combustion engine 1, including the ignition timing of the spark plug 9 and the opening of the electronic throttle 3. Here, however, description will be limited to control performed during start-up.

The engine controller 21 is constituted by a microcomputer comprising a central processing unit (CPU), read-only memory (ROM), random access memory (RAM), and an input/output interface (I/O interface). The engine controller 21 may be constituted by a plurality of microcomputers.

As parameters for performing fuel injection control during start-up, detection data from a fuel pressure sensor 22 which detects a fuel pressure Pf in the common rail 16, a position sensor 23 which outputs a POS signal each time the internal combustion engine 1 rotates by a fixed angle, a phase sensor 24 which outputs a PHASE signal corresponding to the specific stroke position of each combustion chamber 7 of the internal combustion engine 1, an air flow meter 25 which detects the amount of intake air in the intake passage 4, and a water temperature sensor 26 which detects a cooling water temperature Tw in the internal combustion engine 1 are input respectively into the engine controller 21 as signals. The PHASE signal output by the phase sensor 24 is also used as a signal indicating the engine rotation speed Ne.

On the basis of these signals, the engine controller 21 calculates the width of a start-up fuel injection pulse based on a target air-fuel ratio that is close to the stoichiometric air-fuel ratio during start-up of the internal combustion engine 1. With the tumble control valve 17 closed, the engine controller 21 outputs a signal corresponding to the start-up fuel injection pulse width to the fuel injector 8 during the compression stroke of each combustion chamber 7, and thus implements compression stroke fuel injection. The timing of compression stroke fuel injection is determined by the engine controller 21 from the PHASE signal that is output by the phase sensor 24 and the POS signal that is output by the position sensor 23.

The engine controller 21 also increases and decreases the flow rate of the return passage by outputting a duty signal to the electromagnetic control valve of the high pressure fuel pump 15 on the basis of the detected pressure of the fuel pressure sensor 22, and in so doing feedback-controls the fuel pressure in the common rail 16 to a target pressure.

Prior to the execution of compression stroke fuel injection, the engine controller 21 determines whether or not conditions for compression stroke fuel injection have been established on the basis of a predetermined set value of the start-up fuel injection pulse width, the engine rotation speed during cranking, and the fuel pressure in the common rail 16.

Compression stroke fuel injection is executed only after the engine controller 21 determines that the conditions for compression stroke fuel injection have been established. Until the conditions for compression stroke fuel injection are established, the engine controller 21 executes intake stroke fuel injection.

Figure 2:
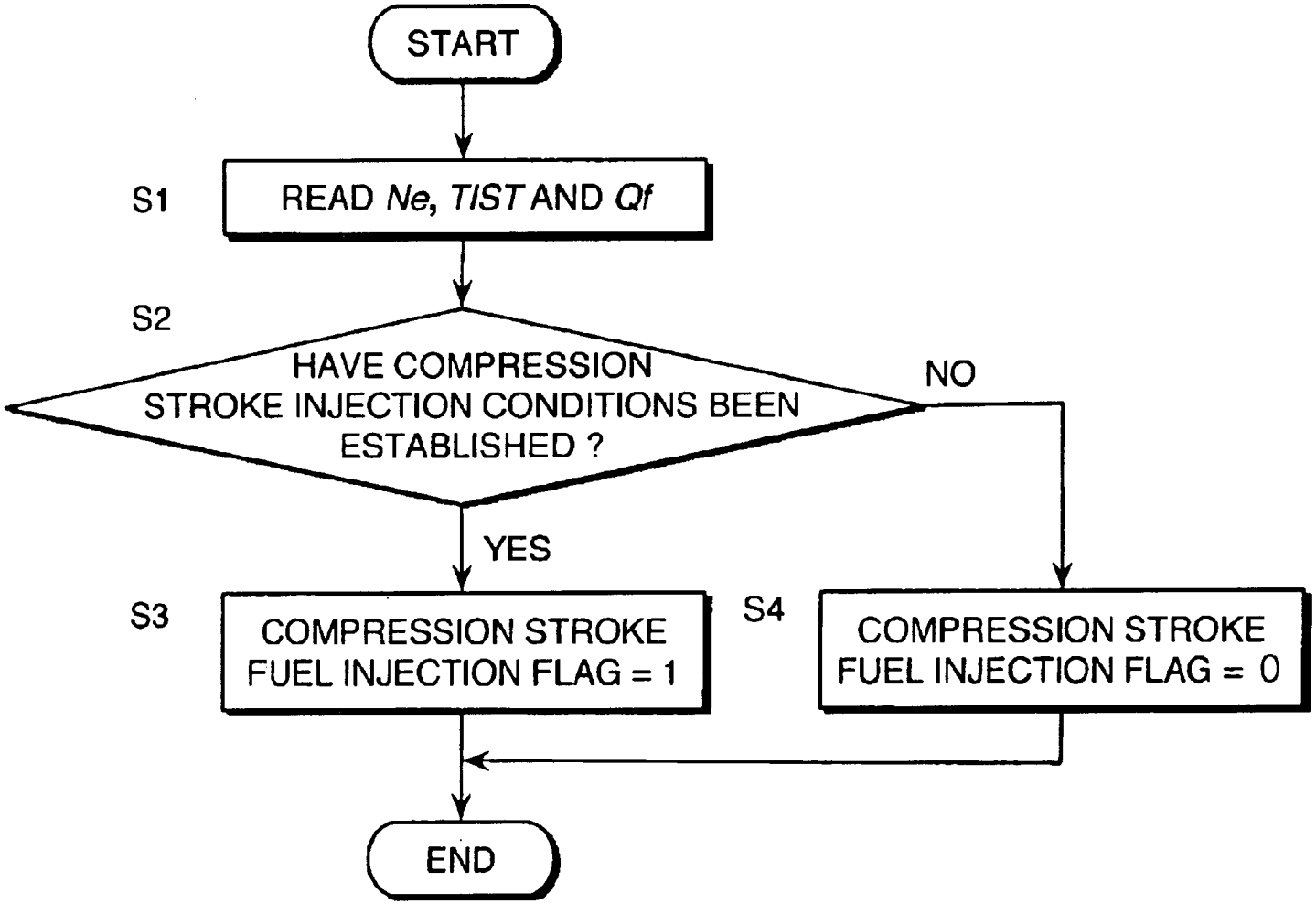
FIG. 2 is a flowchart illustrating a routine for setting a compression stroke fuel injection flag, which is executed by a controller according to this invention.

Referring to FIG. 2, a routine for setting a compression stroke fuel injection flag, which is executed by the engine controller 21 in order to perform this determination, will be described. This routine is executed at intervals of ten milliseconds during the time period from the switching on of a key switch provided in the vehicle to the completion of start-up of the internal combustion engine 1. The completion of start-up of the internal combustion engine 1 is determined when the engine rotation speed Ne exceeds a predetermined complete combustion determining speed.

In a step S1, the engine controller 21 reads the engine rotation speed Ne, the fuel pressure Pf in the common rail 16, and the cooling water temperature Tw to calculate the start-up fuel injection pulse width TIST. The start-up fuel injection pulse width TIST corresponds to the target fuel injection amount in the claims.

The start-up fuel injection pulse width TIST is a value obtained according to the following equation (1). TIST is calculated in units of milliseconds (ms).

$$TIST=TST\cdot MKINJ\cdot KNST\cdot KTST \quad (1)$$

where, TST=start-up basic fuel injection pulse width (ms),

MKINJ=fuel pressure correction coefficient,

KNST=engine rotation speed correction coefficient, and

KTST=time correction coefficient.

Figure 5:
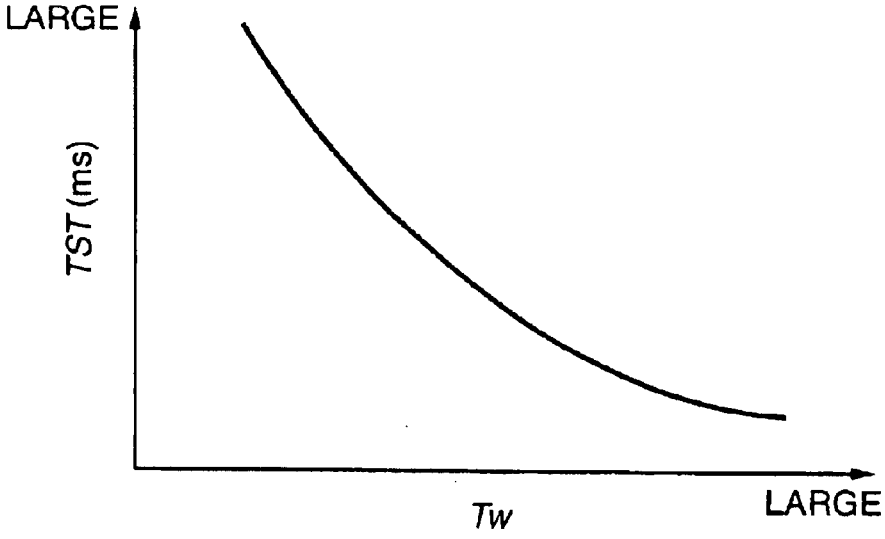
FIG. 5 is a diagram illustrating the characteristic of a map of a start-up basic injection pulse width TST, which is stored by the controller.

The start-up basic fuel injection pulse width TST is determined by the engine controller 21 from the cooling water temperature Tw by referring to a map having the characteristic shown in FIG. 5, which is stored in the ROM in advance. The start-up basic fuel injection pulse width TST is a fuel injection pulse width at which an air-fuel ratio in the vicinity of the stoichiometric air-fuel ratio is obtained in relation to a reference cranking rotation speed and a reference cranking time. According to the map, the start-up basic fuel injection pulse width TST increases as the cooling water temperature Tw decreases.

Figure 6:
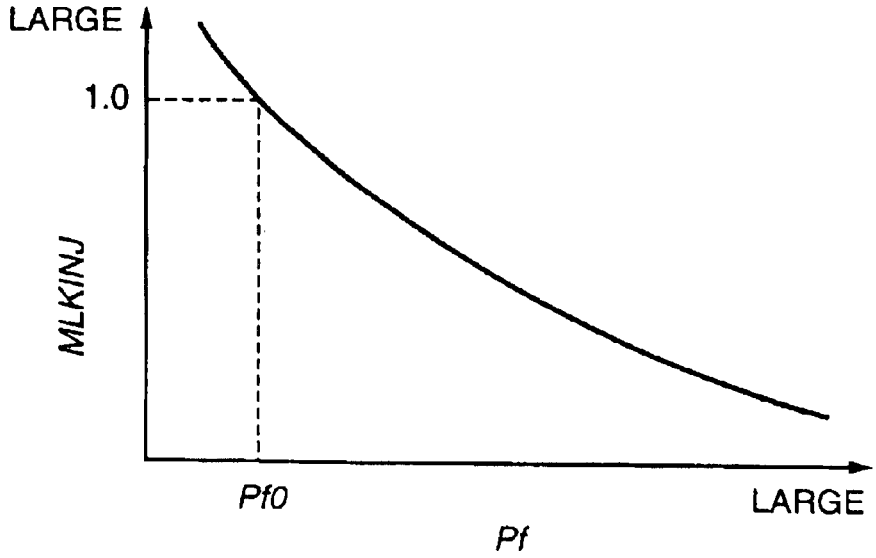
FIG. 6 is a diagram illustrating the characteristic of a fuel pressure correction coefficient MLKINJ stored by the controller.

The fuel pressure correction coefficient MKINJ is determined by the engine controller 21 from the fuel pressure Pf by referring to a map having the characteristic shown in FIG. 6, which is stored in the ROM in advance. The fuel pressure correction coefficient MKINJ is a correction coefficient corresponding to the difference between the fuel pressure Pf and a reference fuel pressure Pf0 shown in the diagram. According to the map, when the fuel pressure Pf is equal to the reference fuel pressure Pf0, the fuel pressure correction coefficient MKINJ is one, and as the fuel pressure Pf exceeds the reference fuel pressure Pf0, the fuel pressure correction coefficient MKINJ decreases.

Figure 7:
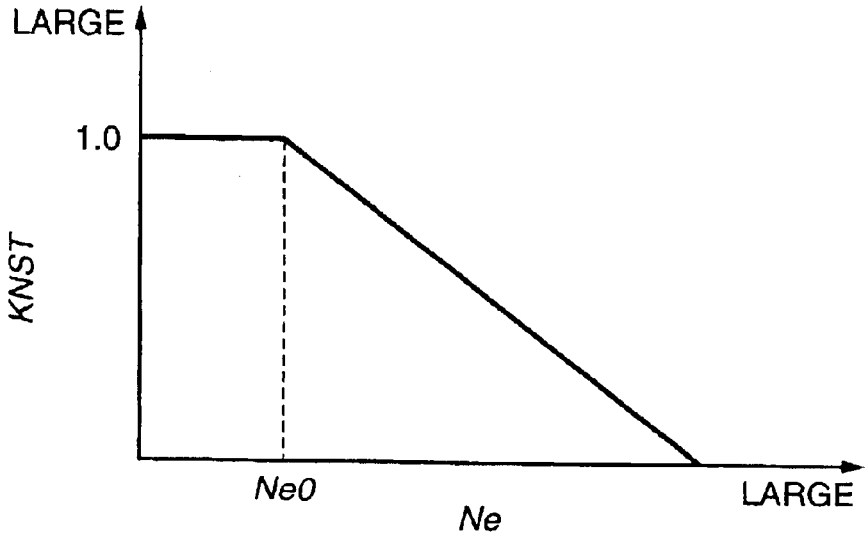
FIG. 7 is a diagram illustrating the characteristic of a rotation speed correction coefficient KNST stored by the controller.

The engine rotation speed correction coefficient KNST is determined by the engine controller 21 from the engine rotation speed Ne by referring to a map having the characteristic shown in FIG. 7, which is stored in the ROM in advance. The engine rotation speed correction coefficient KNST is a correction coefficient corresponding to the difference between the engine rotation speed Ne and the reference cranking rotation speed. According to the map, when the engine rotation speed Ne is equal to or less than a reference cranking rotation speed Ne0 shown in the diagram, the engine rotation speed correction coefficient KNST is one, and as the engine rotation speed Ne exceeds the reference cranking rotation speed Ne0, the engine rotation speed correction coefficient KNST decreases.

Figure 8:
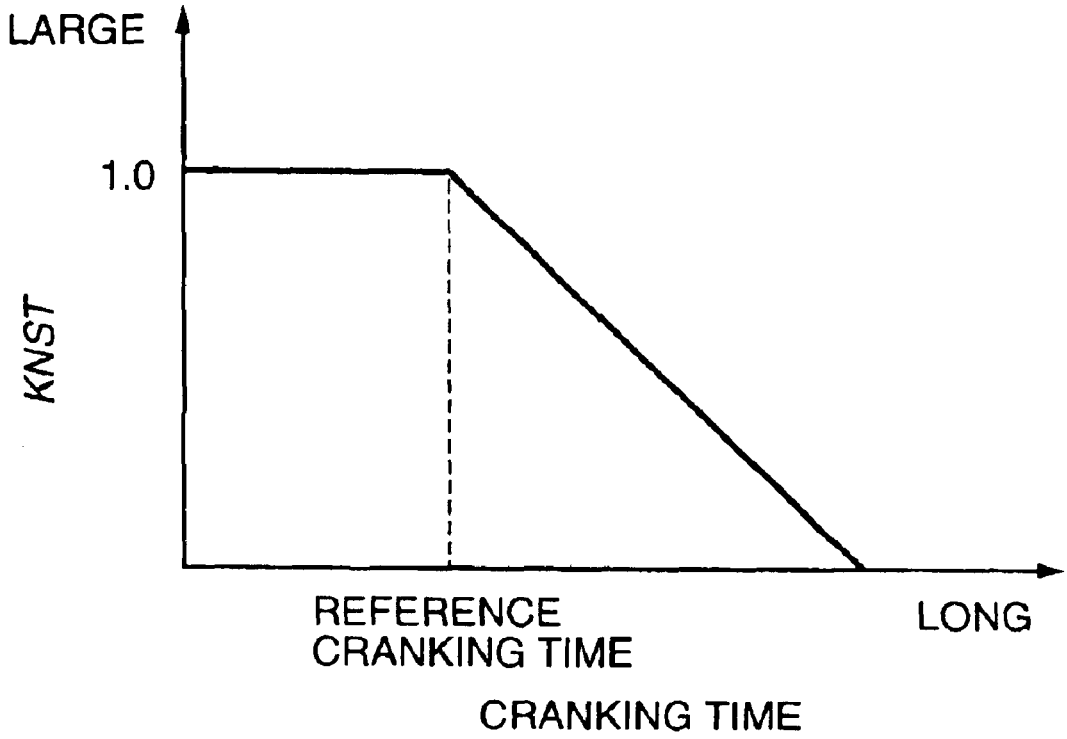
FIG. 8 is a diagram illustrating the characteristic of a time correction coefficient KTST stored by the controller.

The time correction coefficient KTST is determined by the engine controller 21 from the cranking time by referring to a map having the characteristic shown in FIG. 8, which is stored in the ROM in advance. The time correction coefficient KTST is a correction coefficient corresponding to the difference between the cranking time, or in other words the elapsed time from the beginning of cranking, and a reference cranking time. According to the map, when the cranking time is equal to or less than the reference cranking time, the time correction coefficient KTST is one, and as the cranking time exceeds the reference cranking time, the time correction coefficient KTST decreases. The cranking time is measured by a timer function of the engine controller 21.

Figure 3:
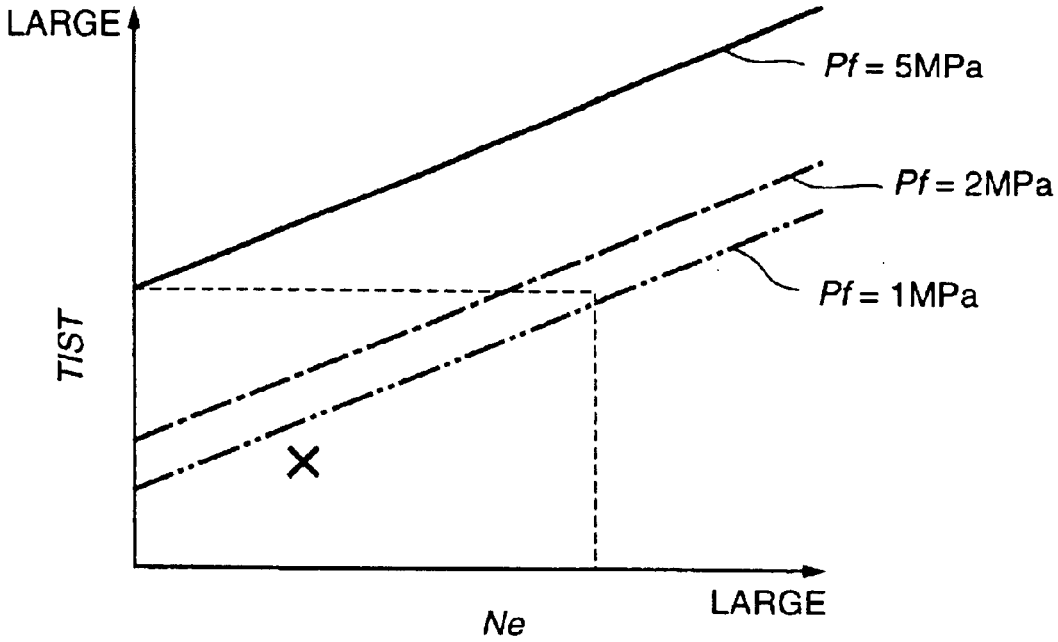
FIG. 3 is a diagram illustrating the characteristic of a map for determining compression stroke fuel injection, which is stored by the controller.

Next, in a step S2, the engine controller 21 determines whether or not the conditions for permitting compression stroke fuel injection have been established from the engine rotation speed Ne, the fuel pressure Pf in the common rail 16, and the start-up fuel injection pulse width TIST by referring to a map having the characteristic shown in FIG. 3, which is stored in the ROM in advance.

Referring to the map in FIG. 3, the required fuel pressure in the common rail 16 is defined according to the engine rotation speed Ne and the start-up fuel injection pulse width TIST. For example, it is assumed that the detected fuel pressure Pf is 1 MPa. If, at this time, a point determined from the engine rotation speed Ne and the start-up fuel injection pulse width TIST is positioned on the underside of the 1 MPa fuel pressure line, as shown by the X mark in the diagram, then the required compression stroke fuel injection can be performed at a lower fuel pressure than 1 MPa.

In this case, the engine controller 21 determines that the conditions for permitting compression stroke fuel injection have been established.

If, on the other hand, the point determined from the engine rotation speed Ne and start-up fuel injection pulse width TIST is positioned on the upper side of the 1 MPa fuel pressure line, this indicates that the required compression stroke fuel injection cannot be performed at a fuel pressure of 1MPa. In this case, the engine controller 21 determines that the conditions permitting compression stroke fuel injection have not been established.

Here, for ease of explanation, only a few fuel pressure lines are illustrated, but in a real map, the fuel pressure lines would be set in more detail, thus enabling a greater degree of determination precision.

When the engine controller 21 determines that the conditions permitting compression stroke fuel injection have been established, the compression stroke fuel injection flag is set to unity in a step S3.

When the engine controller 21 determines that the conditions permitting compression stroke fuel injection have not been established, the compression stroke fuel injection flag is set to zero in a step S4.

Following the processing of the step S3 or the step S4, the engine controller 21 ends the routine.

Figure 4:
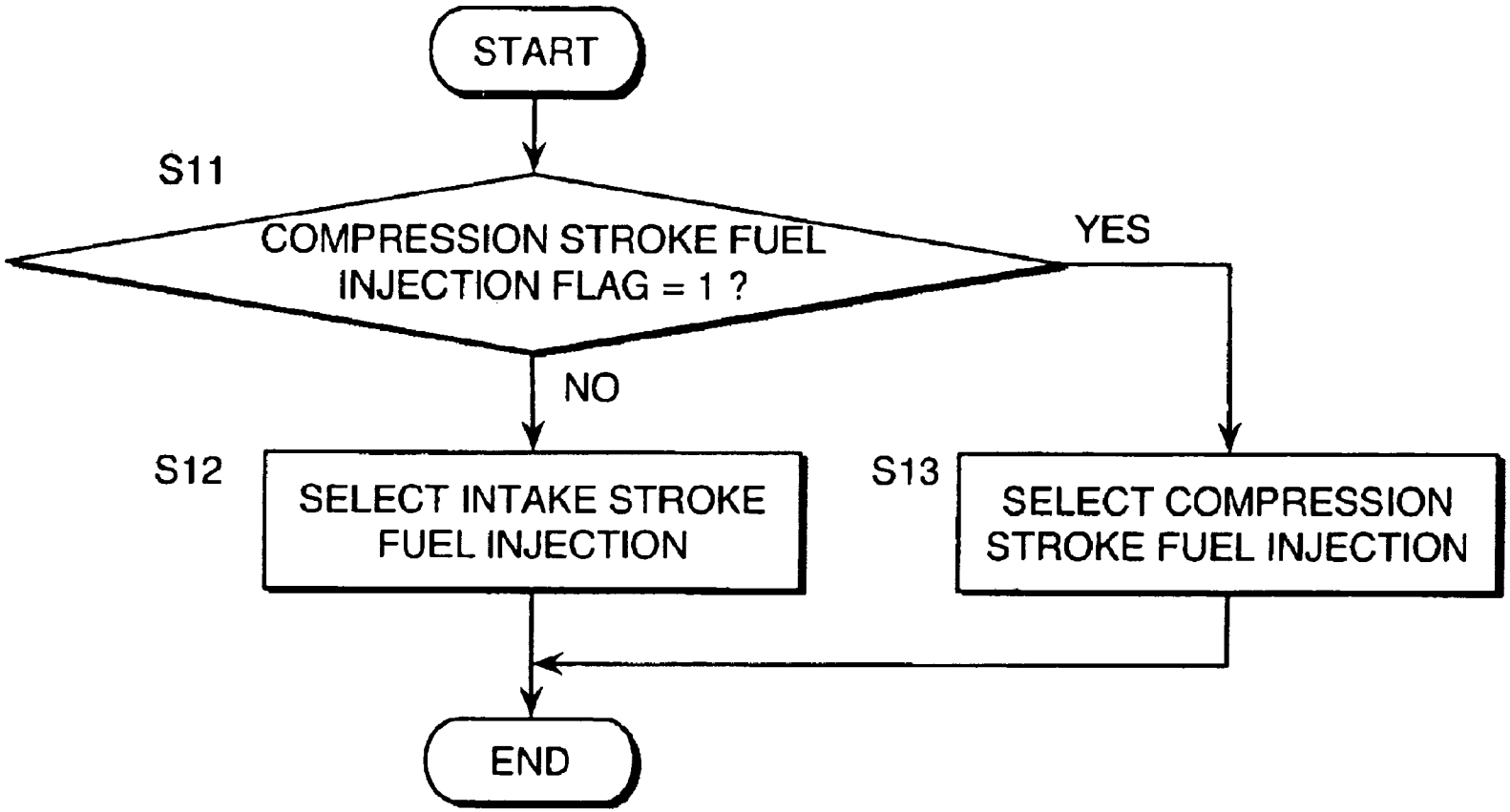
FIG. 4 is a flowchart illustrating a fuel injection control routine executed by the controller.

Next, referring to FIG. 4, a fuel injection control routine executed during start-up of the internal combustion engine 1 by the engine controller 21 will be described. This routine is executed at intervals of ten milliseconds from the beginning of cranking to the completion of start-up of the internal combustion engine 1. The beginning of cranking is determined when the engine rotation speed Ne changes from zero to a value other than zero.

First, in a step S11, the engine controller 21 determines whether or not the compression stroke fuel injection flag is at unity.

When the compression stroke fuel injection flag is at zero, the engine controller 21 selects intake stroke fuel injection in a step S12. Simultaneously, the tumble control valve 17 is closed such that stratified combustion is performed in the combustion chamber 7.

When the compression stroke fuel injection flag is at unity, the engine controller 21 selects compression stroke fuel injection in a step S13. Simultaneously, the tumble control valve 17 is opened such that homogeneous combustion is performed in the combustion chamber 7.

In either case, the start-up fuel injection pulse width TIST calculated in the routine in FIG. 2 is applied as the fuel injection amount. It should be noted that since the fuel injection timing and the routine execution timing differ, fuel injection is not actually performed in the steps S12 and S13. The timing of the fuel injection selected in the steps S12 and S13 is applied to fuel injection directly after execution of the routine.

Stratified combustion is performed in the internal combustion engine 1 at times other than during start-up, for example during a normal operation. Accordingly, the fuel pressure Pf in the common rail 16 must be raised to 5 MPa–7 MPa, as shown in FIG. 3, to enable compression stroke fuel injection in all of the stratified combustion regions.

When limited to start-up, however, the fuel pressure Pf required for compression stroke fuel injection is no more than approximately 2 MPa. Moreover, according to this invention, the compression stroke fuel injection flag is set by comparing the required fuel pressure to the fuel pressure Pf detected by the fuel pressure sensor 22 on the basis of the engine rotation speed Ne and the start-up fuel injection pulse width TIST, as shown by the X mark in the diagram, and hence the fuel pressure that is deemed to be required during the start-up time period is held within a range of 1 MPa–2 MPa.

Hence, in comparison with the prior art, opportunities for applying compression stroke fuel injection during start-up of the internal combustion engine 1 increase greatly, as a result of which the amount of discharged hydrocarbon (HC) during start-up can be reduced. During a cold start, unburned fuel tends to be discharged as HC, but according to this invention, the opportunities for performing stratified combustion by means of compression stroke fuel injection during start-up increase, and hence the amount of HC discharge during a cold start can be reduced.

The contents of Tokugan 2003-193447, with a filing date of Jul. 8, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in the embodiment described above, the engine rotation speed Ne, fuel pressure Pf, and cooling water temperature Tw are detected respectively using sensors, but this invention is not dependent on these parameter obtaining means, and may be applied to any start-up fuel injection control device and start-up fuel injection control method which perform the claimed control using obtained parameters.

The embodiments of this invention in which an exclusive property or privilege is claimed are defined as follows:

What is claimed is:

1. A start-up fuel injection control device for an in-cylinder fuel injection internal combustion engine which operates on a four-stroke cycle constituted by an intake stroke, a compression stroke, an expansion stroke, and an exhaust stroke, the engine comprising a fuel injector which injects fuel directly into a combustion chamber, the control device controlling a fuel injection timing in accordance with a rotation speed of the engine, and a fuel pressure at which fuel is supplied to the fuel injector, the control device comprising:

a programmable controller programmed to:

set a target fuel injection amount during start-up which corresponds to an air-fuel ratio in the vicinity of a stoichiometric air-fuel ratio;

determine whether or not a compression stroke fuel injection condition has been established on the basis of the target fuel injection amount during start-up, the engine rotation speed, and the fuel pressure; and control the fuel injector to inject fuel during the compression stroke only when the compression stroke fuel injection condition has been established.

2. The start-up fuel injection control device as defined in claim 1, wherein the controller is further programmed to control the fuel injector to inject fuel during the intake stroke when the compression stroke fuel injection condition has not been established.

3. The start-up fuel injection control device as defined in claim 1, wherein the controller is further programmed to calculate a required fuel pressure of the fuel injector on the basis of the engine rotation speed and the target fuel injection amount during start-up, and to determine that the compression stroke fuel injection condition has not been established when the fuel pressure of the fuel that is supplied to the fuel injector is lower than the required fuel pressure.

4. The start-up fuel injection control device as defined in claim 3, wherein the controller is further programmed to decrease the required fuel pressure as the engine rotation speed increases, and increase the required fuel pressure as the target fuel injection amount during start-up increases.

5. The start-up fuel injection control device as defined in claim 1, wherein the engine further comprises a high pressure fuel pump which supplies high-pressure fuel to the fuel injector, the high pressure fuel pump being driven in accordance with the rotation of the engine, and a spark plug which ignites an air-fuel mixture of fuel injected into the combustion chamber by the fuel injector and air, and the control device further comprises a sensor which detects the fuel pressure of the fuel that is supplied to the fuel injector from the high pressure fuel pump, and a sensor which detects the engine rotation speed.

6. The start-up fuel injection control device as defined in claim 1, wherein the engine further comprises a tumble control valve which forms a tumble within the combustion chamber, and the controller is further programmed to control the tumble control valve to form the tumble within the combustion chamber when the compression stroke fuel injection condition has been established.

7. The start-up fuel injection control device as defined in claim 1, wherein the control device further comprises a sensor which detects a temperature of the engine, and the controller is further programmed to increase the target fuel injection amount during start-up as the temperature of the engine decreases.

8. The start-up fuel injection control device as defined in claim 7, wherein the controller is further programmed to correct the target fuel injection amount during start-up using a coefficient which reduces the target fuel injection amount as the fuel pressure of the fuel that is supplied to the fuel injector increases, a coefficient which reduces the target fuel injection amount as the engine rotation speed increases, and a coefficient which reduces the target fuel injection amount as an elapsed time from start-up of the engine increases.

9. A start-up fuel injection control device for an in-cylinder fuel injection internal combustion engine which operates on a four-stroke cycle constituted by an intake stroke, a compression stroke, an expansion stroke, and an exhaust stroke, the engine comprising a fuel injector which injects fuel directly into a combustion chamber, the control device controlling a fuel injection timing in accordance with a rotation speed of the engine, and a fuel pressure at which fuel is supplied to the fuel injector, the control device comprising:

means for setting a target fuel injection amount during start-up which corresponds to an air-fuel ratio in the vicinity of a stoichiometric air-fuel ratio;

means for determining whether or not a compression stroke fuel injection condition has been established on the basis of the target fuel injection amount during start-up, the engine rotation speed, and the fuel pressure; and means for controlling the fuel injector to inject fuel during the compression stroke only when the compression stroke fuel injection condition has been established.

10. A start-up fuel injection control method for an in-cylinder fuel injection internal combustion engine which operates on a four-stroke cycle constituted by an intake stroke, a compression stroke, an expansion stroke, and an exhaust stroke, the engine comprising a fuel injector which injects fuel directly into a combustion chamber, the control method controlling a fuel injection timing in accordance with a rotation speed of the engine, and a fuel pressure at which fuel is supplied to the fuel injector, the control method comprising:

setting a target fuel injection amount during start-up which corresponds to an air-fuel ratio in the vicinity of a stoichiometric air-fuel ratio;

determining whether or not a compression stroke fuel injection condition has been established on the basis of the target fuel injection amount during start-up, the engine rotation speed, and the fuel pressure; and controlling the fuel injector to inject fuel during the compression stroke only when the compression stroke fuel injection condition has been established.

* * * * *